United States Patent [19]

Röck et al.

[11] 4,104,762

[45] Aug. 8, 1978

[54] FURNITURE HINGE

[76] Inventors: Erich Röck, Küferstr. 1085, A-6973 Höchst; Bernhard Mages, Härte 10, A-6850 Dornbirn, both of Austria

[21] Appl. No.: 786,678

[22] Filed: Apr. 11, 1977

[30] Foreign Application Priority Data

Apr. 14, 1976 [AT] Austria ..... 2723/76

[51] Int. Cl.[2] ..... E05D 7/04

[52] U.S. Cl. ..... 16/129

[58] Field of Search ..... 16/129–134, 16/163, 164

[56] References Cited

U.S. PATENT DOCUMENTS

| | | | |
|---|---|---|---|
| 3,772,735 | 11/1973 | Lautenschlaeger | 16/129 |
| 3,890,670 | 6/1975 | Sening et al. | 16/129 |
| 3,913,173 | 10/1975 | Rock et al. | 16/130 |
| 3,977,042 | 8/1976 | Lautenschlaeger | 16/130 |
| 4,011,627 | 3/1977 | Salice | 16/129 |

FOREIGN PATENT DOCUMENTS

| | | | |
|---|---|---|---|
| 2,356,000 | 5/1975 | Fed. Rep. of Germany | 16/129 |
| 1,478,801 | 7/1977 | United Kingdom | 16/129 |

*Primary Examiner*—James Kee Chi

*Attorney, Agent, or Firm*—Haseltine, Lake & Waters

[57] ABSTRACT

A hinge comprising a mounting plate, a hinge arm connected to a hinge casing by links and an intermediate part positioned between the hinge arm and the mounting plate whereby the intermediate part is clamped onto the mounting plate by means of a set-screw.

7 Claims, 3 Drawing Figures

FURNITURE HINGE

BACKGROUND OF THE INVENTION

FIELD OF THE INVENTION

The invention relates to a hinge with a mounting plate which can be fixed to an element of a piece of furniture, a side-panel for example, and with a hinge arm which carries hinge links or the like whereby an intermediate part is placed between the mounting plate and the hinge arm.

If an intermediate part is placed between the mounting plate and the actual hinge arm it is generally possible to anchor and thus fasten the hinge arm whereby a later adjustment of the hinge arm is possible in order to compensate certain tolerances which can occur when the mounting plate is fixed in its position.

SUMMARY OF THE INVENTION

It is the object of the present invention to produce an intermediate part which is especially suited for a height adjustment of the hinge arm.

In order to achieve this according to the invention the intermediate part and the mounting plate have oblique lateral faces which correspond to one another and are lying on sides opposite to one another and which are, furthermore, inclined towards the mounting plane and extend parallel to the axis of rotation resp. pivoting axis of the hinge whereby the intermediate part is kept in position on the mounting plate by a set-screw or the like.

It is a further object of the invention to firmly support the intermediate part and at the same time the hinge arm so that it cannot be pressed out of its position by the weight of the door wing in the course of time.

According to the invention this is achieved by providing three oblique lateral faces which are positioned in the corners of a triangle whereby the mounting plate and/or the intermediate part is provided with a recess between two oblique lateral faces. The recess guarantees a firm support also in case of small amounts of dirt in the area of the edges.

A further preferred embodiment of the invention provides that all oblique lateral faces are inclined in the same direction so that the intermediate part need not be laterally pushed onto the mounting plate and that, furthermore, a spreading effect is created between the mounting plate and the intermediate part by fastening the set-screw.

In the following the invention is illustrated in detail by means of the figures of the attached drawings without being limited thereto.

DESCRIPTION OF THE PREFERRED EMBODIMENT

Figure 1:
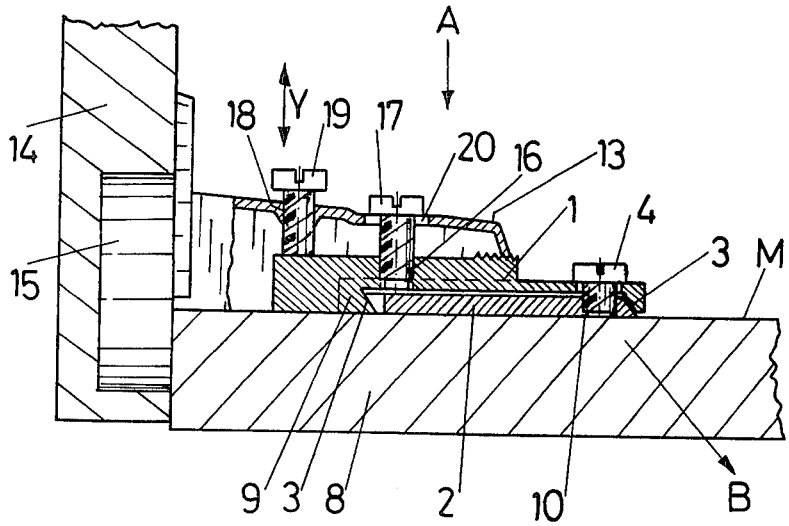
FIG. 1 is a longitudinal section through a hinge arm with a mounting plate according to the invention with an intermediate part.
Figure 2:
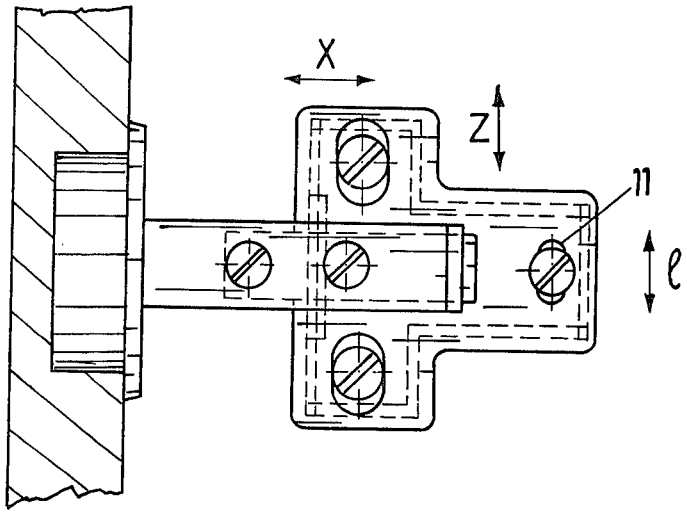
FIG. 2 is a plan view in direction of arrow A of FIG. 1.

In FIG. 1 the direction of adjustment in the door joint of the piece of furniture is indicated by the double arrow *y* and in FIG. 2 the double arrow *x* indicates the direction of adjustment in the depth of the piece of furniture and the double arrow *z* the direction of adjustment in the height of the piece of furniture.

According to the invention a mounting plate 2 is provided which can be fixed to a side-panel of the piece of furniture by fastening screws 7 in a conventional way. The mounting plate 2 has guiding devices on two sides which are oblique lateral faces 3.

By means of a projection 9 the intermediate part 1 which also has oblique lateral faces 3 can be inserted on one side into the mounting plate 2, namely on the oblique lateral faces 3 whereby the oblique lateral face 5 of the intermediate part 1 lies on the opposite end on the oblique lateral face 3 of the mounting plate 2.

On the opposite side the oblique lateral faces 3 of the mounting plate 2 and of the intermediate part 1 are inclined in the same direction. Thereby the intermediate part 1 does not extend under the mounting plate 2 but lies on the mounting plate 2 as particularly illustrated in FIG. 1.

Figure 3:
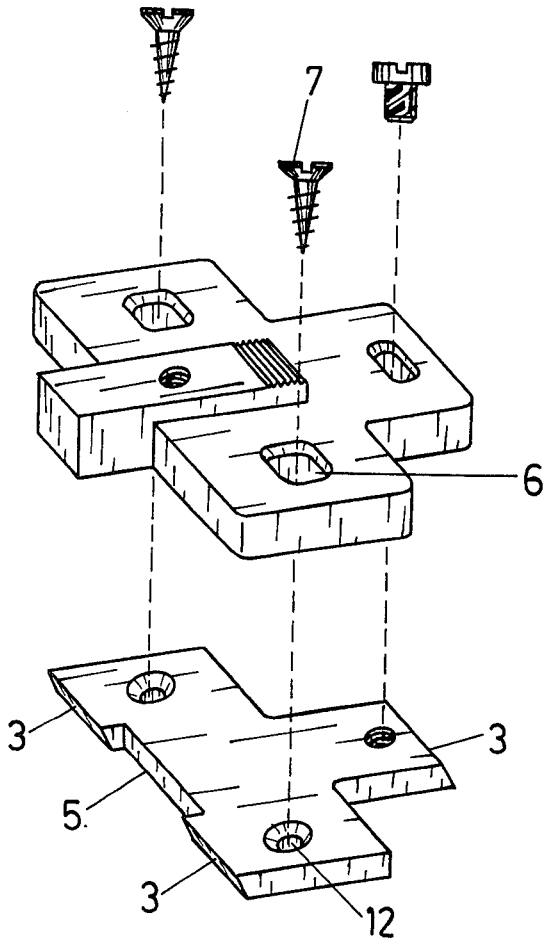
FIG. 3 is a diagram of a mounting plate and an intermediate part according to the invention.

If the set-screw 4 which rests in a female screw thread 10 of the mounting plate 2 is fastened the intermediate part 1 will be clamped to the mounting plate 2 approximately in the direction of arrow B. As illustrated in FIGS. 2 and 3 the set-screw thereby projects through a longitudinal slot 11 in the intermediate part 1. In the embodiment the length 1 of the longitudinal slot corresponds to the distance of the height adjustment plus the diameter of the set-screw 4.

The intermediate part 1 can be supplied being already connected with the mounting plate 2 by the set-screw 4 and mounted on the side-panel 8 of the piece of furniture. Holes 6 are provided for this purpose through which fastening screws 7 can be inserted into their mounting supports 12 and through which a screwdriver can also be introduced in order to fasten the fastening screw 7.

As has already been mentioned, for assembling the mounting plate 2 together with the intermediate part 1 is fixed to the side-panel 8 of the piece of furniture. Subsequently the hinge arm 13 which is connected with a hinge casing 15 inserted in the door wing 14 by hinge links which are not illustrated is positioned on the intermediate part 1. The type of the hinge links and the bearings of the hinge links are not separately illustrated in the figures of the drawing as they are not subject of the present invention and familiar to every person skilled in the art.

The intermediate part 1 is provided with a female screw thread 16 into which a check screw 17 can be screwed. The hinge arm 13 itself has a female screw thread 18 in which an adjusting screw 19 is mounted for the adjustment of the joints.

The hinge arm 13 in which an adjusting screw 19 has already been mounted is positioned on the intermediate part 1. Then the check screw 17 is inserted into the slot 20 of the hinge arm 13 and screwed into the female screw thread 16. The hinge arm 13 is thereby adjustable over the length of the slot 20 in the depth of the piece of furniture so that a depth adjustment will be possible with regard to the hinge.

Before firmly fastening the check screw 17 the hinge and thus the door wing 14 in the door joint of the piece of furniture can be adjusted by inserting the adjusting screw 19 as far as necessary. In the following the hinge arm 13 is firmly fixed by fastening the check screw 17.

If an adjustment in the height of the piece of furniture is necessary the set-screw 4 can easily be loosened and the intermediate part 1 can be removed on the mounting plate 2 in the direction of the double arrow z. After an adjustment in the height of the piece of furniture the set-screw 4 is fastened.

What is claimed is:

1. A hinge for fastening to a member of piece of furniture, such as a side panel, comprising: a mounting plate fixable to said member of said furniture a hinge arm carrying hinge links; an intermediate part located between said mounting plate and said hinge arm, said intermediate part and said mounting plate having oblique lateral faces parallel to a pivoting axis of the hinge, said faces corresponding to one another and being spaced from each other at least in the direction of the length of said hinge arm; screw means; said intermediate part being held in position at least on said mounting plate by said screw means; all said oblique lateral faces being inclined in the same direction so that said intermediate part is hooked onto said mounting plate by at least one of said oblique lateral faces in at least one point and at least one lateral face of said intermediate part lies atop a corresponding lateral face of said mounting plate in at least a second point, said screw means being positioned in proximity of said second lateral face.

2. A hinge according to claim 1 wherein three oblique lateral faces are positioned in corners of a triangle, said mounting plate having a recess between two oblique lateral faces.

3. A hinge according to claim 1 wherein three oblique lateral faces are positioned in corners of a triangle, said intermediate part having a recess between two oblique lateral faces.

4. A hinge according to claim 2 wherein said intermediate part has also a recess between two oblique lateral faces.

5. A hinge according to claim 1 wherein three oblique lateral faces are positioned in corners of a triangle, recess means in said mounting plate between two oblique lateral faces and in said intermediate part; said intermediate part covering said mounting plate; said intermediate part having holes located in proximity of fastening screws for the mounting plate.

6. A hinge according to claim 1 wherein said intermediate part covers said mounting plate.

7. A hinge according to claim 4 wherein said intermediate part has holes located near fastening screws for the mounting plate.

* * * * *